US010526936B2

(12) United States Patent
Yang et al.

(10) Patent No.: US 10,526,936 B2
(45) Date of Patent: Jan. 7, 2020

(54) SYSTEM FOR ENGINE VALVE ACTUATION COMPRISING LASH-PREVENTION VALVE ACTUATION MOTION

(71) Applicant: Jacobs Vehicle Systems, Inc., Bloomfield, CT (US)

(72) Inventors: Dong Yang, West Hartford, CT (US); Peter Jo, Rocky Hill, CT (US); Justin D. Baltrucki, Canton, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 45 days.

(21) Appl. No.: 15/280,063

(22) Filed: Sep. 29, 2016

(65) Prior Publication Data

US 2017/0089232 A1 Mar. 30, 2017

Related U.S. Application Data

(60) Provisional application No. 62/234,608, filed on Sep. 29, 2015.

(51) Int. Cl.
*F01L 1/08* (2006.01)
*F01L 13/06* (2006.01)
(Continued)

(52) U.S. Cl.
CPC ..... *F01L 13/085* (2013.01); *F01L 1/08* (2013.01); *F01L 1/24* (2013.01); *F01L 13/06* (2013.01);
(Continued)

(58) Field of Classification Search
CPC . F01L 13/085; F01L 13/06; F01L 1/24; F01L 13/065; F01L 1/08; F01L 2800/10;
(Continued)

(56) References Cited

U.S. PATENT DOCUMENTS 6,415,752 B1 * 7/2002 Janak ..... F01L 1/181 123/90.12
6,422,186 B1 * 7/2002 Vanderpoel ..... F01L 1/181 123/90.15
(Continued)

FOREIGN PATENT DOCUMENTS

DE 102013215946 A1 2/2015
EP 2988526 A1 3/2016
(Continued)

OTHER PUBLICATIONS

International Search Report for International Application No. PCT/US2016/054437, dated Dec. 14, 2016, 3 pages.
(Continued)

*Primary Examiner* — J. Todd Newton
(74) *Attorney, Agent, or Firm* — Moreno IP Law LLC

(57) ABSTRACT

A system for actuating engine valve comprises a main valve actuation motion source configured to supply main valve actuation motions to the at least one engine valve via a main motion load path, and an auxiliary valve actuation motion source separate from the main valve actuation motion source and configured to supply complementary auxiliary valve actuation motions to the at least one engine valve via an auxiliary motion load path. A lost motion component is configured, in one state, to maintain lash between the auxiliary valve actuation motion source and the auxiliary motion load path or within the auxiliary motion load path and, in another state, to take up this lash. The auxiliary valve actuation motion source is further configured to supply at least one lash-prevention valve actuation motion that substantially matches at least one of the main valve actuation motions.

8 Claims, 8 Drawing Sheets

(51) Int. Cl.
*F01L 13/08* (2006.01)
*F01L 1/24* (2006.01)

(52) U.S. Cl.
CPC ..... *F01L 13/065* (2013.01); *F01L 2800/10* (2013.01); *F01L 2800/19* (2013.01)

(58) Field of Classification Search
CPC ..... F01L 2800/19; F01L 13/0005; F01L 13/0063; F01L 13/0036; F01L 13/0031
USPC ..... 123/90.16
See application file for complete search history.

(56) References Cited

U.S. PATENT DOCUMENTS

| | | | | |
|---|---|---|---|---|
| 7,712,449 | B1 * | 5/2010 | Schwoerer | F01L 1/08 123/321 |
| 9,234,467 | B2 * | 1/2016 | Ernest | F02D 13/04 |
| 9,845,713 | B2 * | 12/2017 | Ernest | F01L 13/0036 |
| 2005/0000499 | A1 * | 1/2005 | Ruggiero | F01L 1/08 123/568.14 |
| 2005/0211206 | A1 * | 9/2005 | Ruggiero | F01L 1/08 123/90.16 |
| 2010/0071643 | A1 * | 3/2010 | Smith | F01L 1/181 123/90.15 |
| 2013/0269653 | A1 * | 10/2013 | Yang | F01L 1/08 123/323 |
| 2014/0020644 | A1 * | 1/2014 | Roberts | F01L 1/18 123/90.46 |
| 2014/0182536 | A1 * | 7/2014 | Yang | F01L 1/181 123/90.39 |
| 2016/0084119 | A1 * | 3/2016 | Sugiura | F01L 1/185 123/90.16 |
| 2016/0281612 | A1 * | 9/2016 | Toth | F01L 13/065 |
| 2016/0356187 | A1 * | 12/2016 | Meneely | F01L 13/06 |
| 2017/0089232 | A1 * | 3/2017 | Yang | F01L 1/08 |
| 2017/0241305 | A1 * | 8/2017 | Xi | F01L 13/06 |

FOREIGN PATENT DOCUMENTS

| | | | |
|---|---|---|---|
| JP | 2001523790 | A | 11/2001 |
| JP | 2014515456 | A | 6/2014 |
| KR | 20140036266 | A | 3/2014 |
| WO | 0242612 | A1 | 5/2002 |
| WO | 2008073122 | A1 | 6/2008 |
| WO | 2012038101 | A1 | 3/2012 |

OTHER PUBLICATIONS

Written Opinion of the International Searching Authority for for International Application No. PCT/US2016/054437, dated Dec. 9, 2016, 6 pages.
Supplemental European Search Report for European Application No. 16852592 dated Apr. 15, 2019, 10 pages.
International Preliminary Report on Patentability for International Application No. PCT/US2016/054437, dated Apr. 3, 2018, 7 pages.

* cited by examiner

- PRIOR ART -

- PRIOR ART -

- PRIOR ART -

- PRIOR ART -

- PRIOR ART -

- PRIOR ART -

- PRIOR ART -

- PRIOR ART -

- PRIOR ART -

SYSTEM FOR ENGINE VALVE ACTUATION COMPRISING LASH-PREVENTION VALVE ACTUATION MOTION

CROSS-REFERENCE TO RELATED APPLICATION

The instant application claims the benefit of Provisional U.S. Patent Application Ser. No. 62/234,608 entitled "METHOD FOR PREVENTING JACKING OF AN AUXILIARY MOTION PISTON DURING PRIMARY VALVE MOTIONS IN AN INTERNAL COMBUSTION ENGINE" and filed Sep. 29, 2015, the teachings of which are incorporated herein by this reference.

FIELD

The instant disclosure relates generally to internal combustion engines and, in particular, to a system for providing valve actuation motions within such internal combustion engines.

BACKGROUND

As known in the art, internal combustion engines operate, in part, through the controlled actuation of engine valves. For example, for each cylinder in an internal combustion engine, there are typically at least one intake engine valve and at least one exhaust engine valve. When an internal combustion engine is operating to produce power, the engine valves are actuated in accordance with so-called (and well-known) main valve actuation motions. Additionally, the engine valves may be actuated in accordance with so-called auxiliary valve actuation motions, which may be used instead of or in addition to the main valve actuation motions, so as to modify operation of the internal combustion engine.

For example, such auxiliary valve actuation motions may be used to achieve compression release braking, or engine braking. As known in the art, compression release braking converts an internal combustion engine from a power generating unit into a power consuming air compressor through selective control of various engine valves, particularly exhaust valves. Generally, the exhaust valve(s) for a given cylinder actuated by a rocker arm that, in turn, is often operatively connected to a single exhaust valve or a plurality of exhaust valves by way of a valve bridge.

An example of such a prior art system 100 is schematically illustrated in FIG. 1. In particular, the system 100 comprises a main valve actuation motion source 102 used to actuate (or provide motions to) engine valves 104, 106 via a main motion load path or valve train 106 (which may include a valve bridge 110 in the illustrated embodiment). Similarly, the system 100 comprises an auxiliary valve actuation motion source 112 used to actuation the engine valves 104, 106 via an auxiliary motion load path or valve train 114 (which may also include a bridge pin 116 in the illustrated embodiment). Though FIG. 1 illustrates two engine valves 104,106, it is understood that this is not a requirement as a single engine valve of a given type (i.e., intake or exhaust) may be equally employed.

As used herein, the valve actuation motion sources 102, 112 may comprise any components that dictate the motions to be applied to an engine valve including hydraulic, electric, pneumatic or mechanical components, e.g., cams, electronically-controlled actuators, etc. Conversely, the motion load paths or valve trains 108, 114 may comprise any one or more components deployed between a motion source and an engine valve and used to convey motions provided by the motion source to the engine valve, e.g., tappets, rocker arms, pushrods, valve bridges, automatic lash adjusters, lost motion components, etc. Furthermore, as used herein, the descriptor "main" or "primary" refers to features of the instant disclosure concerning so-called main event engine valve motions, i.e., valve motions used during positive power generation, whereas the descriptor "auxiliary" refers to features of the instant disclosure concerning auxiliary engine valve motions, i.e., valve motions used during engine operation other than conventional positive power generation (such as, but not limited to, compression release braking, bleeder braking, cylinder decompression, brake gas recirculation (BGR), etc.) or in addition to conventional positive power generation (such as, but not limited to, internal exhaust gas recirculation (IEGR), variable valve actuations (VVA), Miller/Atkinson cycle, swirl control, etc.).

FIG. 1 also illustrates a lost motion component 118 within the auxiliary motion load path 114. As known in the art, the lost motion component 118 is a mechanism that, in a first state, maintains lash or clearance 120 between the auxiliary valve actuation motion source 112 and a component in the auxiliary motion load path 114, or between components within the auxiliary motion load path 114, such that valve actuation motions supplied by the auxiliary valve actuation motion source 112 are not transferred via the auxiliary motion load path 114, i.e., they are "lost." For ease of illustration, the lash 120 provided by the lost motion component 118 is illustrated between the auxiliary motion load path 114 and, in the illustrated example, the bridge pin 116. However, it is again noted that this lash 120 may be provided between other components as noted above. Conversely, in a second state, the lost motion component 118 takes up the lash 120 such that the valve actuation motions supplied by the auxiliary valve actuation motion source 112 are transferred via the auxiliary motion load path 114 to the engine valve(s) 104, 106. As known in the an, the lost motion component 118 is often implemented as a hydraulically-actuated device, an example of which is illustrated in FIGS. 3 and 4. In the example of FIGS. 3 and 4, the auxiliary valve actuation motion source 112, is implemented as a rotating cam, as known in the art. Further, the lost motion component 118 is implemented in the form of a piston 302 slidably disposed within a bore housing 304. Further still, a bias spring 306 is provided between the piston 302 and bore housing 304 such that it maintains the lash space 120 between the piston 302 and the cam 112. As shown in FIG. 4, application of hydraulic pressure to the opposite face of the piston 302 (via a hydraulic, channel not shown) causes the piston 302 to extend from the bore 304, thereby taking up the lash space 120 and bringing the piston 302 into contact with the cam 112. By hydraulically locking the hydraulic fluid actuating the piston 302 (using, for example, a control valve as known in the art) the motions supplied by the cam 112 may be transferred via the piston 302.

As further shown in FIG. 1, either or both of the main load path 108 and the auxiliary load path 114 may comprise an optional automatic lash adjuster 122, 124, which may be desirable to avoid the requirement to set lash normally used to account for thermal expansion and/or component wear. As used herein, an automatic lash adjuster may be included within a motion load path to the extent that it is used to take up lash in the motion load path, and operates either directly within, or parallel to, the motion load path.

Finally, FIG. 1 also illustrates the possibility that auxiliary valve actuation motion source 112' and auxiliary motion load path 114' may be placed in series with, rather than in parallel to, the main motion load path 108. That is, the some or all of the main motion load path 108 may be used as part of the auxiliary motion load path 114', as known in the art. Once again, in this embodiment, the lash 120' provided by the lost motion component 124' is schematically illustrated between the auxiliary motion load path 114' and the main motion load path 108.

A problem with systems 100 of the type illustrated in FIG. 1, i.e., having separately implemented main and auxiliary valve actuation motion sources 102, 112 in combination with components capable of taking up lash space, i.e., lost motion components 118 and/or automatic lash adjusters 124, is the potential for those components to over-extend or "pump up" when not intended or desired. If such over extension (sometimes referred to as "jacking") occurs, the motion load path in which such a component is deployed may effectively prevent proper seating of an engine valve, thereby resulting in poor performance and/or emissions and, in some instances, catastrophic valve-to-piston impact.

An example of this is illustrated with further reference to FIGS. 1, 2 and 5-7. In particular, FIG. 2 illustrates a main valve lift curve 202 and an auxiliary valve lift curve 208 for an exhaust valve that illustrate examples of valve actuation motions that may be caused by respective ones of the main and auxiliary valve actuation motion sources 102, 112. In the illustrated examples, the main lift curve 202 comprises a base circle portion 204 in which no lift is provided, as well as a main lift event 206, whereas the auxiliary lift curve 208 comprises a base circle portion 210, a BGR lift event 212 and a compression-release lift event 214. Note that the non-zero lifts in each curve 202, 208 are complementary to each other in that they do not overlap and yet provide the complete set of motions to be applied to the valve. As shown, the curves 202, 208 illustrated in FIG. 2 assume that the lost motion component 118 is currently in a state where the auxiliary valve lifts 208 are lost, as illustrated by the lash 120 such that that the auxiliary lift events 212, 214 are "below" the base circle portion 204 of the main valve lifts 202. Note that the lash 120 is greater than the maximum lift event provided by the auxiliary lift curve 208. This is further schematically illustrated in FIG. 1 by the lack of connection between the auxiliary motion load path 114 and the bridge pin 116, i.e., no valve actuation motions are conveyed by the auxiliary motion load path 114 to the bridge pin 116. Consequently, only the main lift event 206 is conveyed to bridge 110.

When the lost motion component is configured to take up the lash 120, as illustrated in FIG. 6 (in which the lost motion component 118 and optional automatic lash adjusters 122, 124 are not shown for ease of illustration), the lift curves 202, 208 are as shown in FIGS. 7 and 9, in which both the main and auxiliary valve actuation motions are conveyed to the engine valves 104, 106. Thus, for example, at time $t_1$ shown in FIG. 7, the auxiliary motion load path 114 conveys those valve actuation motions that result in the compression-release valve event 214 being applied the bridge pin 116 and the engine valve 104. Note that, at time $t_1$, the main valve lift curve is at its zero lift portion indicating that the main motion load path is not applying any lift to the valve bridge 110.

However, as shown in FIG. 9, at time $t_2$, the opposite is true; i.e., the main valve lift curve is at its main lift event 206 whereas the auxiliary valve lift curve is at its zero lift point. In this case, as shown in FIG. 8, when the main motion load path 108 is applying a high lift to the valve bridge 110 and the auxiliary motion load path 108 is applying none, a lash 802 based on the height of the main lift event 206 will develop between the auxiliary motion load path 114 and, in this example, the bridge pin 116. In this case, the lost motion component 118 (not shown in FIG. 8) may attempt to take up this additional lash 802 as illustrated by the dashed arrow connecting to the bridge pin 116. This is further illustrated in the example of FIG. 5, in which the piston 302 will, under the applied hydraulic pressure, attempt to take up the additional lash 802. Consequently, at time $t_3$ shown in FIG. 9, when the main lift event 206 has concluded, and both valve lift curves are at their respective zero lift portions, the lost motion component 118 will remain in its pumped-up or over-extended state, thereby possibly preventing complete closure of the engine valve 104.

This same problem may result where the auxiliary motion load path 114 includes the automatic lash adjuster 124 instead of or in addition to the lost motion component 118, as described above.

In order to prevent such jacking, the lost motion component 118 (and/or automatic lash adjuster 124) can be designed with a stroke limiter that prevent extension beyond a certain limit. However, this necessarily complicates the design and increases the cost of these components. Still other solutions, such as that described in U.S. Pat. No. 9,200,541, provide relatively complex piston designs that absorb certain motions while permitting other motions to be conveyed. Again, however, this increases design complexity and cost.

Thus, it would be advantageous to provide systems that address these shortcomings of existing systems.

SUMMARY

The instant disclosure describes technique that address the shortcomings of prior art approaches. In particular, in accordance with an embodiment described herein, a system for actuating engine valve comprises a main valve actuation motion source configured to supply main valve actuation motions to the at least one engine valve via a main motion load path, and an auxiliary valve actuation motion source separate from the main valve actuation motion source and configured to supply auxiliary valve actuation motions to the at least one engine valve via an auxiliary motion load path, wherein the auxiliary valve actuation motions are complementary to the main valve actuation motions. The main and auxiliary motion load paths may be separate from each other or the auxiliary motion load path may include at least a portion of the main motion load path. Further still, either or both of the main and auxiliary motion load paths may comprise an automatic lash adjuster. The system further comprises a lost motion component, which may comprise a hydraulically-actuated piston, configured, in one state, to maintain lash between the auxiliary valve actuation motion source and the auxiliary motion load path or within the auxiliary motion load path and, in another state, to take up the lash between the auxiliary valve actuation motion source and the auxiliary motion load path or within the auxiliary motion load path. In this embodiment, the auxiliary valve actuation motion source is further configured to supply at least one lash-prevention valve actuation motion that substantially matches at least one of the main valve actuation motions. In this manner, the at least one lash-prevention valve actuation motion induces motion within the auxiliary motion load path that substantially prevents the creation of lash due to the otherwise complementary nature of the main valve actuation motions and the auxiliary valve actuation motions.

In an embodiment the auxiliary valve actuation motion source is a cam, and the at least one lash-prevention valve actuation motion is implemented as an additional lobe on the cam. Further, in another embodiment, the at least one lash-prevention valve actuation motion substantially matches a primary or main valve lift of the main valve actuation motions. The system described herein may be provided to operate upon either intake or exhaust valves, or may be separately provided to operate upon both types of engine valves.

BRIEF DESCRIPTION OF THE DRAWINGS

The features described in this disclosure are set forth with particularity in the appended claims. These features and attendant advantages will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 1:
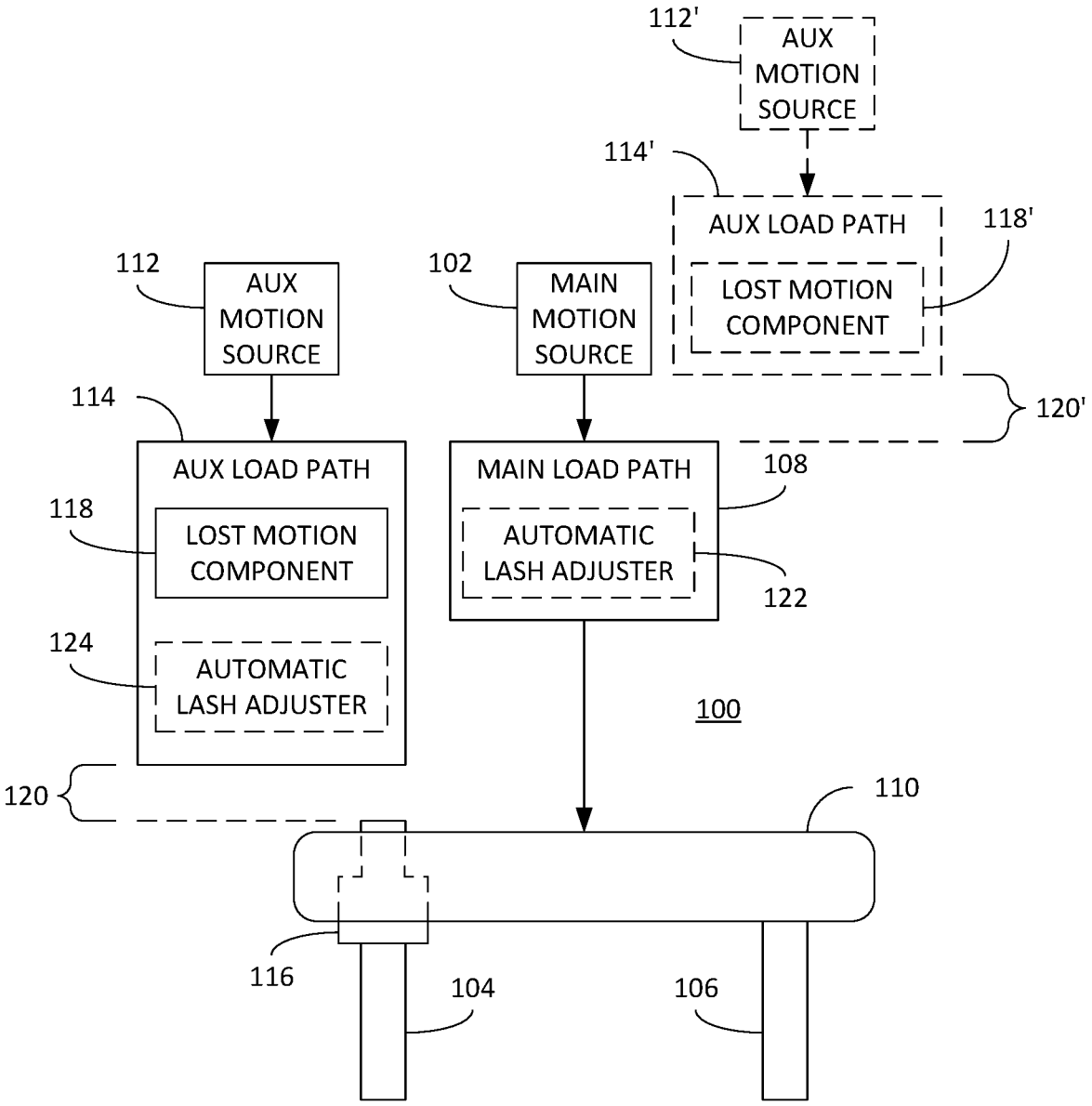
FIGS. 1, 6 and 8 are schematic block diagrams of a system for actuating engine valves in accordance with prior art techniques.
Figure 2:
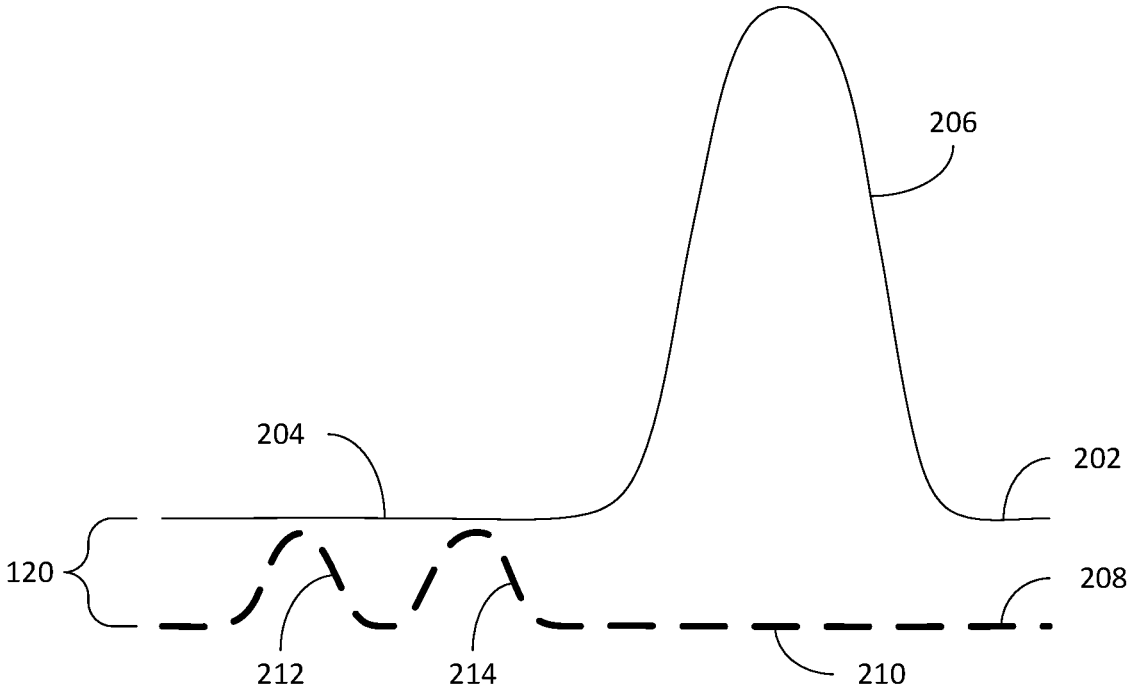
FIGS. 2, 7 and 9 show both main and auxiliary valve lift curves in accordance with prior art techniques.
Figure 3:
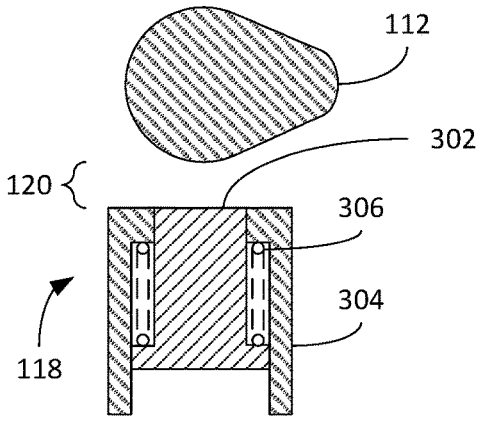
FIGS. 3-5 are schematic, cross-sectional illustrations of a lost motion component in accordance with prior art techniques.
Figure 4:
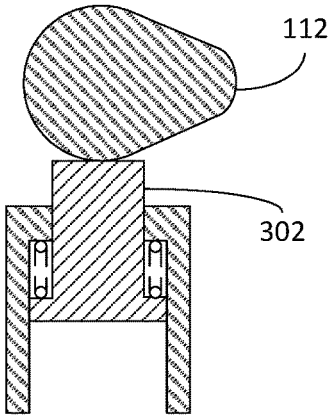
Figure 5:
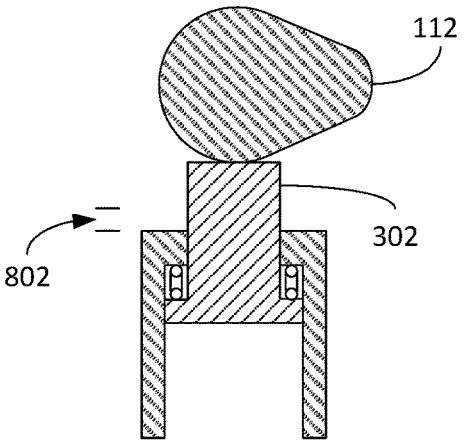
Figure 6:
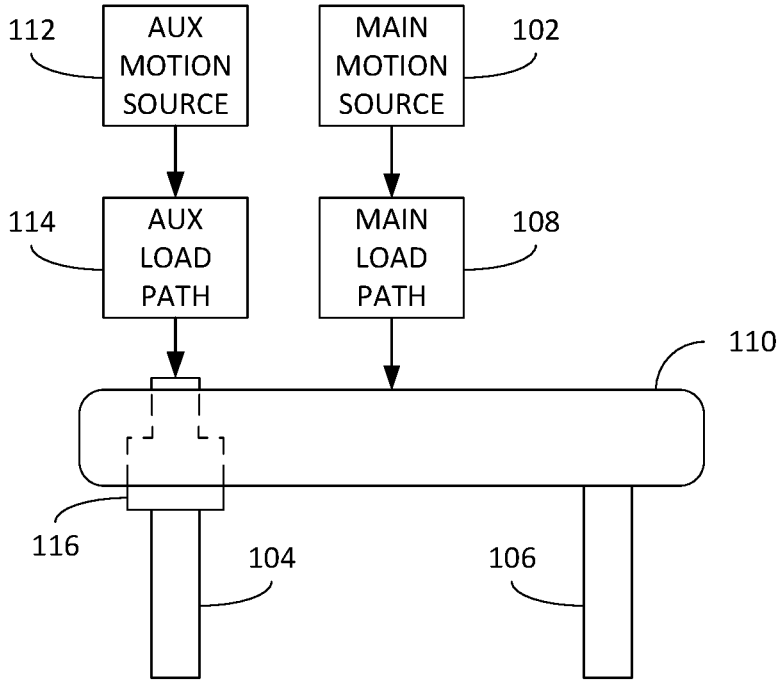
Figure 7:
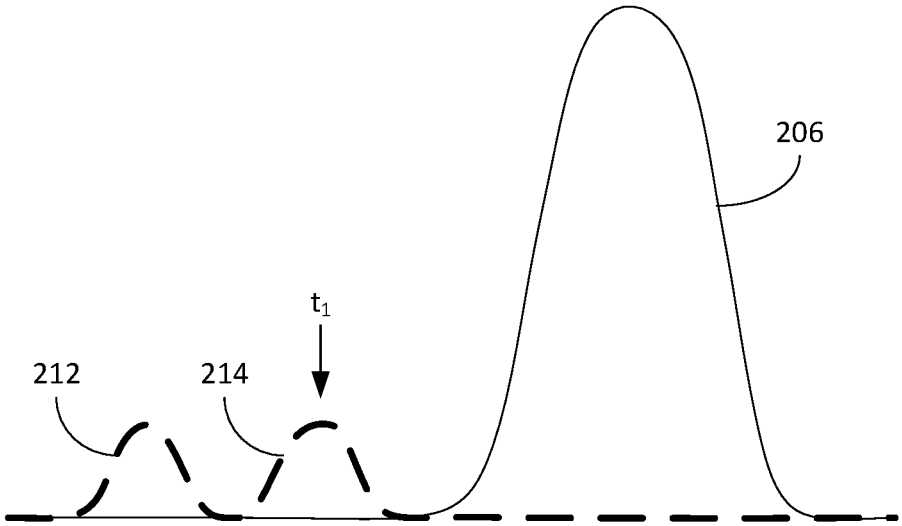
Figure 10:
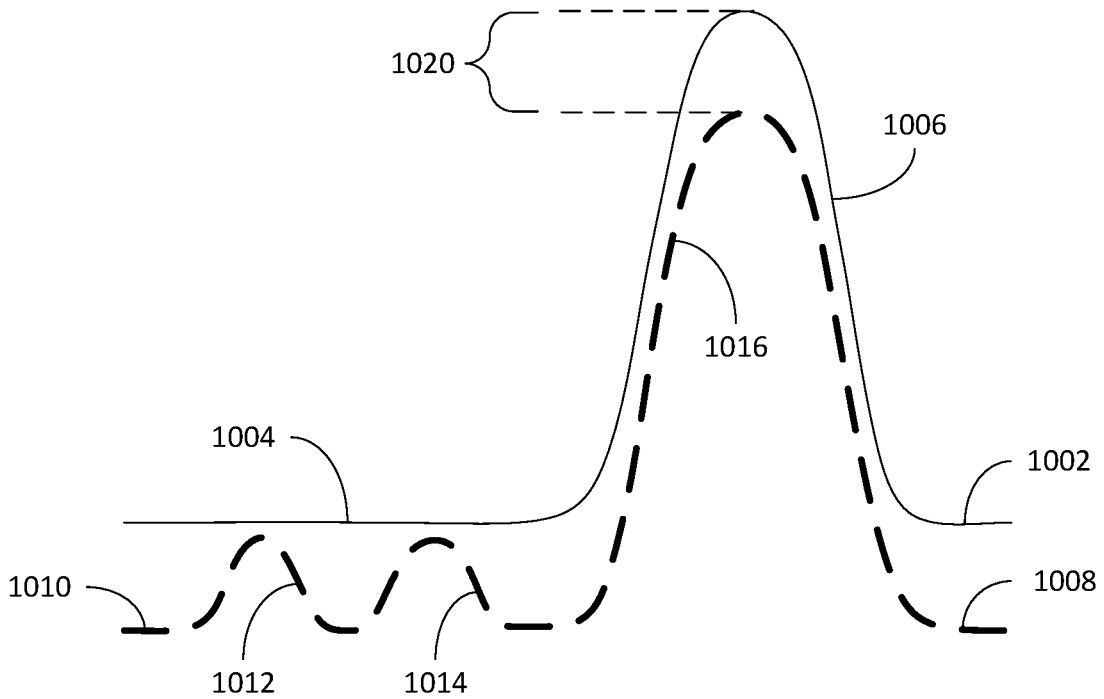
FIGS. 10 and 11 show both main and auxiliary valve lift curves in accordance with the instant disclosure.
Figure 11:
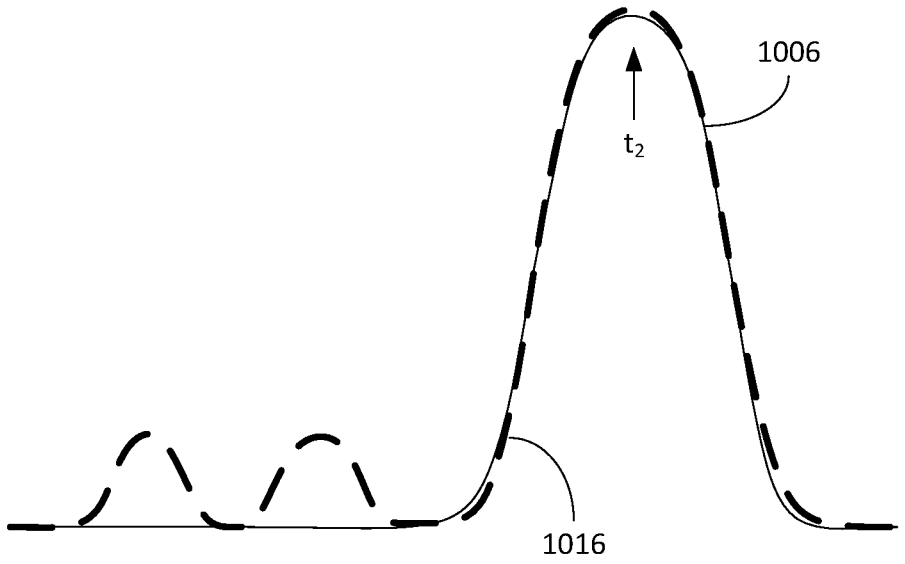

Referring now to FIGS. 10 and 11, examples of a main valve lift curve 1002 and an auxiliary valve lift curve 1008 for an exhaust valve that may be caused by respective ones of the main and auxiliary valve actuation motion sources 102, 1202. In the illustrated examples, the main lift curve 1002 comprises a base circle portion 1004 in which no lift is provided, as well as a main lift event 1006, whereas the auxiliary lift curve 1008 comprises a base circle portion 1010, a BGR lift event 1012, a compression-release lift event 1014 and a lash-prevention valve actuation motion 1016. As in the case of FIGS. 2 and 7, with the exception of the lash-prevention valve actuation motion 1016, the non-zero lifts in each curve 1002, 1008 are complementary to each other in that they do not overlap and yet provide the complete set of motions to be applied to the valve. As in the case with FIG. 2, the curves 1002, 1008 illustrated in FIG. 10 assume that the lost motion component 118 (not shown in FIG. 13) is currently in a state where the auxiliary valve lifts 1008 are lost, as illustrated by the lash 1020 such that that the auxiliary lift events 1012, 1014 are "below" the base circle portion 1004 of the main valve lift curve 1002.

Figure 12:
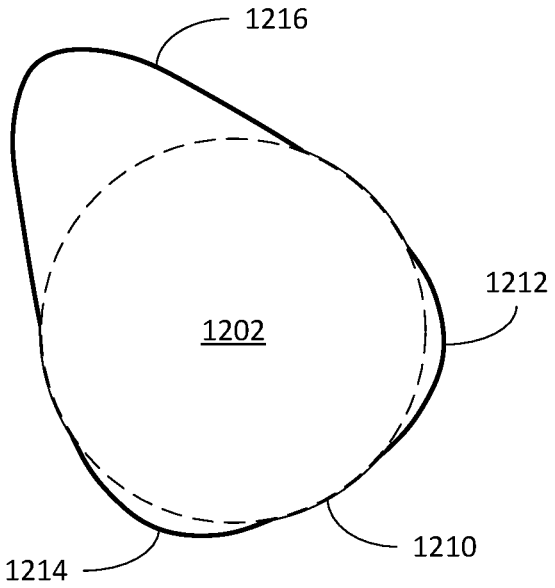
FIG. 12 illustrates an auxiliary valve actuation motion source in the form of a cam that may be used to implement a lash-prevention valve actuation motion in accordance with the instant disclosure.

As noted, however, the lash-prevention valve actuation motion 1016 is not complementary to the lifts illustrated in the main valve lift curve 1002. In fact, the lash-prevention valve actuation motion 1016 substantially matches the main lift event 1006, as best illustrated in FIG. 11 (corresponding to that state in which the lost motion component 118 takes up the lash 1020 between the curves 1002, 1008). An example of an auxiliary valve actuation motion source 1202 that may be used to implement the auxiliary valve lifts 1008 is illustrated in FIG. 12. In particular, the auxiliary valve actuation motion source 1202 is implemented in FIG. 12 as a cam having a base circle portion 1210 (corresponding to the zero lift portion 1010 of FIG. 10), a BGR cam lobe 1212 (corresponding to the BGR lift event 1012 of FIG. 10), a compression-release cam lobe 1214 (corresponding to the compression-release lift event 1014 of FIG. 10) and a lash-prevention cam lobe 1216 (corresponding to the lash-prevention valve actuation motion 1016 of FIG. 10). As will be appreciated by those having skill in the art, the cam lobes 1212, 1214, 1216 illustrated in FIG. 12 do not necessarily match the exact profile of the valve lifts 1012, 1014, 1016 illustrated in FIG. 10.

Figure 8:
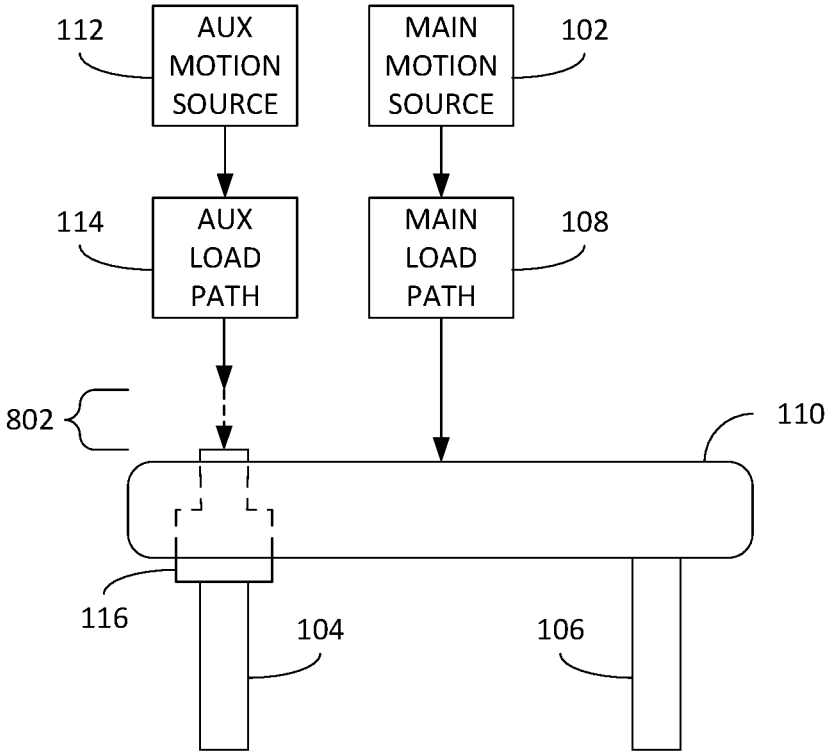
Figure 9:
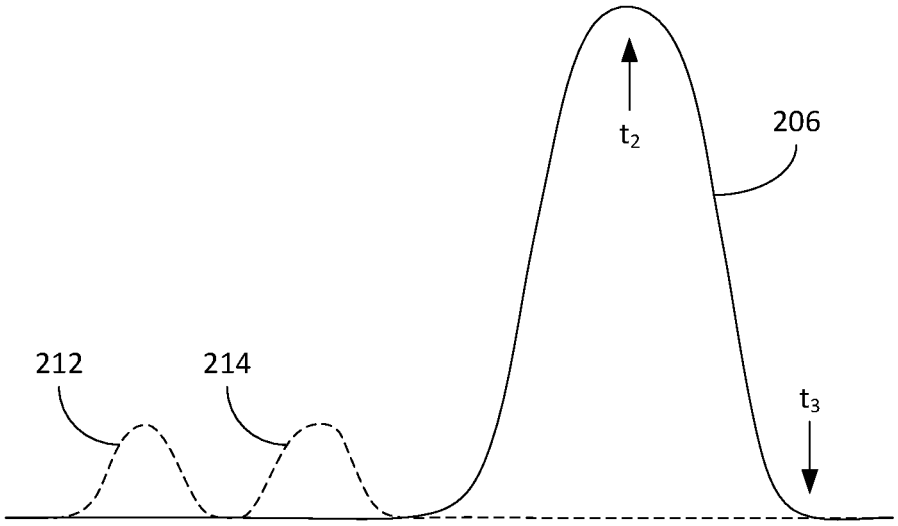
Figure 13:
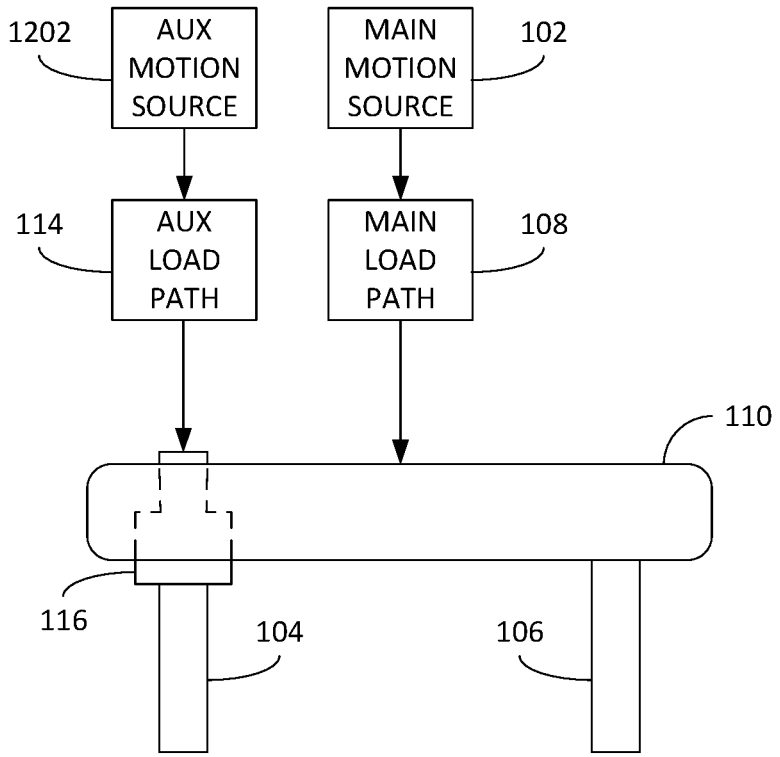
FIG. 13 is a schematic block diagram of a system for actuating engine valves in accordance with the instant disclosure.

As best shown in FIG. 11, the substantially matching characteristics (e.g., maxim valve lift, duration, shapes, etc.) of the lash-prevention valve actuation motion 1016 and, in the illustrated example, the main lift event 1006 results in the establishment of substantially no or little lash space between the auxiliary motion load path 114 and the bridge pin 116 during application of the main lift event 1006 to the valve bridge 110 (at and around time $t_2$ shown in FIG. 11). This is illustrated in FIG. 13, in contrast with FIG. 8, in which the auxiliary motion load path 114 remains in contact with the bridge pin 116 thereby eliminating the additional lash 802 shown in FIG. 8, and thereby further avoiding any extension of the lost motion component 118 (or automatic lash adjuster 124, if provided) in an effort to take up such additional lash space 802.

Consequently, provision of the lash-prevention valve actuation motion 1016 eliminates the need for complex and costly configurations of the lost motion component 118 found in prior art solutions. Additionally, by substantially eliminating one of the complications arising from use of an automatic lash adjuster 124 in the auxiliary motion load path 114, both the main and auxiliary motion load paths 108, 114 may operate in a lashless manner, thereby eliminating the time- and labor-intensive need to set lash in these load paths 108, 114 experienced with prior art solutions.

It should be noted that, while examples have been described in the instant disclosure in terms of exhaust valves, it is understood that the techniques described herein may be equally applied to intake valves.

While particular preferred embodiments have been shown and described, those skilled in the art will appreciate that changes and modifications may be made without departing from the instant teachings. It is therefore contemplated that any and all modifications, variations or equivalents of the above-described teachings fall within the scope of the basic underlying principles disclosed above and claimed herein.

What is claimed is:

1. A system for use in an internal combustion engine having at least one engine valve associated with a cylinder, the system comprising:

a main valve actuation motion source configured to supply main valve actuation motions to the at least one engine valve via a main motion load path;

an auxiliary valve actuation motion source separate from the main valve actuation motion source and configured to supply auxiliary valve actuation motions to the at least one engine valve via an auxiliary motion load path, wherein the auxiliary valve actuation motions are complementary to the main valve actuation motions; and a lost motion component configured, in, one state, to maintain lash between the auxiliary valve actuation motion source and the auxiliary motion load path or within the auxiliary motion load path and, in another state, to take up the lash between the auxiliary valve actuation motion source and the auxiliary motion load path or within the auxiliary motion load path, the auxiliary valve actuation motion source further comprising a lash-prevention valve actuation motion component for providing at least one lash-prevention valve actuation motion that substantially matches a primary valve lift of the main valve actuation motions.

2. The system of claim 1, wherein the auxiliary valve actuation motion source is a cam, and the at least one lush-prevention valve actuation motion component is implemented as an additional lobe on the cam.

3. The system of claim 1, wherein the lost motion component comprises a hydraulically controlled piston.

4. The system of claim 1, wherein the auxiliary motion load path includes the main motion load path.

5. The system of claim 1, wherein the main motion load path comprises an automatic lash adjuster.

6. The system of claim 1, wherein the auxiliary motion load path comprises an automatic lash adjuster.

7. The system of claim 1, wherein the at least one engine valve comprises at least one exhaust valve.

8. The system of claim 1, wherein the at least one engine valve comprises at least one intake valve.

* * * * *